US007647678B2

(12) United States Patent
Smith

(10) Patent No.: US 7,647,678 B2
(45) Date of Patent: Jan. 19, 2010

(54) CONTAMINATION RESISTANT BUCKLE

(75) Inventor: Paul M. Smith, Davison, MI (US)

(73) Assignee: TK Holdings Inc., Auburn Hills, MI (US)

( * ) Notice: Subject to any disclaimer, the term of this patent is extended or adjusted under 35 U.S.C. 154(b) by 0 days.

(21) Appl. No.: 11/905,167

(22) Filed: Sep. 27, 2007

(65) Prior Publication Data

US 2009/0083955 A1 Apr. 2, 2009

(51) Int. Cl.
*A44B 11/26* (2006.01)

(52) U.S. Cl. ..... 24/633

(58) Field of Classification Search ..... 24/633; 297/468

See application file for complete search history.

(56) References Cited

U.S. PATENT DOCUMENTS 4,675,954 A * 6/1987 Gullickson ..... 24/633
4,870,726 A * 10/1989 Eksell et al. ..... 24/636
4,942,649 A * 7/1990 Anthony et al. ..... 24/637
5,416,957 A * 5/1995 Renzi et al. ..... 24/633
5,970,587 A * 10/1999 Knox ..... 24/633
6,055,708 A * 5/2000 Ellis et al. ..... 24/642

* cited by examiner

*Primary Examiner*—James R Brittain
(74) *Attorney, Agent, or Firm*—Foley & Lardner LLP

(57) ABSTRACT

An vehicle seat belt includes a buckle system. The buckle system includes a seat belt buckle with a buckle face, a release button, and an opening for receiving a seat belt tongue. The buckle includes a seal positioned on the buckle face to seal the buckle face and prevent contaminants from entering the interior cavity of the buckle. Should contaminants penetrate the seal, drain holes located on the bottom side of the seat belt buckle may allow the contaminants to pass through the interior cavity of the buckle rather than harm the internal components of the seat belt buckle. Additionally, the seal, made of a flexible material, may aid in the prevention of noises that occur when the buckle comes in contact with other vehicle components.

9 Claims, 5 Drawing Sheets

CONTAMINATION RESISTANT BUCKLE

BACKGROUND

The present invention relates generally to the field of vehicle seat belts. More specifically, the invention relates generally to vehicle seat belts and a mechanism to prevent contaminants from affecting the operation of the seat belt buckle.

Generally, seat belt buckle designs have a moveable press button and an opening that are designed to meet the requirements of several governing bodies in addition to automobile manufacturer's standards for button release forces, etc. The opening, which receives the locking portion of the seat belt, may allow contaminants to pass through and potentially harm the interior components of the seat belt buckle. Buckles are positioned in an upright position in vehicles for ease of operation and detection. This configuration places the opening in a vulnerable position for contamination.

Therefore, there is a need for a vehicle seat belt buckle that is protected from potential damage caused by liquids, debris, and other contaminants that may occur during the normal operation of the vehicle.

SUMMARY

An exemplary embodiment relates to a seat belt buckle system. The seat belt buckle system comprises a seat belt buckle with a buckle face, a button, and an opening for receiving a seat belt tongue. The seat belt buckle includes a seal positioned on the buckle face to seal the buckle face except for the opening for the tongue, such that contaminants are prevented from entering the interior cavity of the buckle.

Another exemplary embodiment relates to a seat belt buckle system. The seat belt buckle system comprises a seat belt buckle with a buckle face, a button, and an opening for receiving a seat belt tongue. The buckle includes a sheathing to cover the buckle. The sheathing includes an opening corresponding with the opening for the tongue to permit the tongue to latch in the buckle.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

Seat belts are provided in vehicles to protect occupants in the event of a vehicle crash. Seat belt buckles generally have a moveable press button and an opening configured to receive a locking device, or tongue. The buckle and opening are generally configured in a vehicle in an upright position for ease of use and detection which adversely places the opening in a position to accumulate contaminants. Debris and liquid may enter the buckle around the button area. Additionally, the opening is not protected and does not prevent contaminants from entering the buckle latch opening, thus compromising the operation of the buckle.

Figure 1:
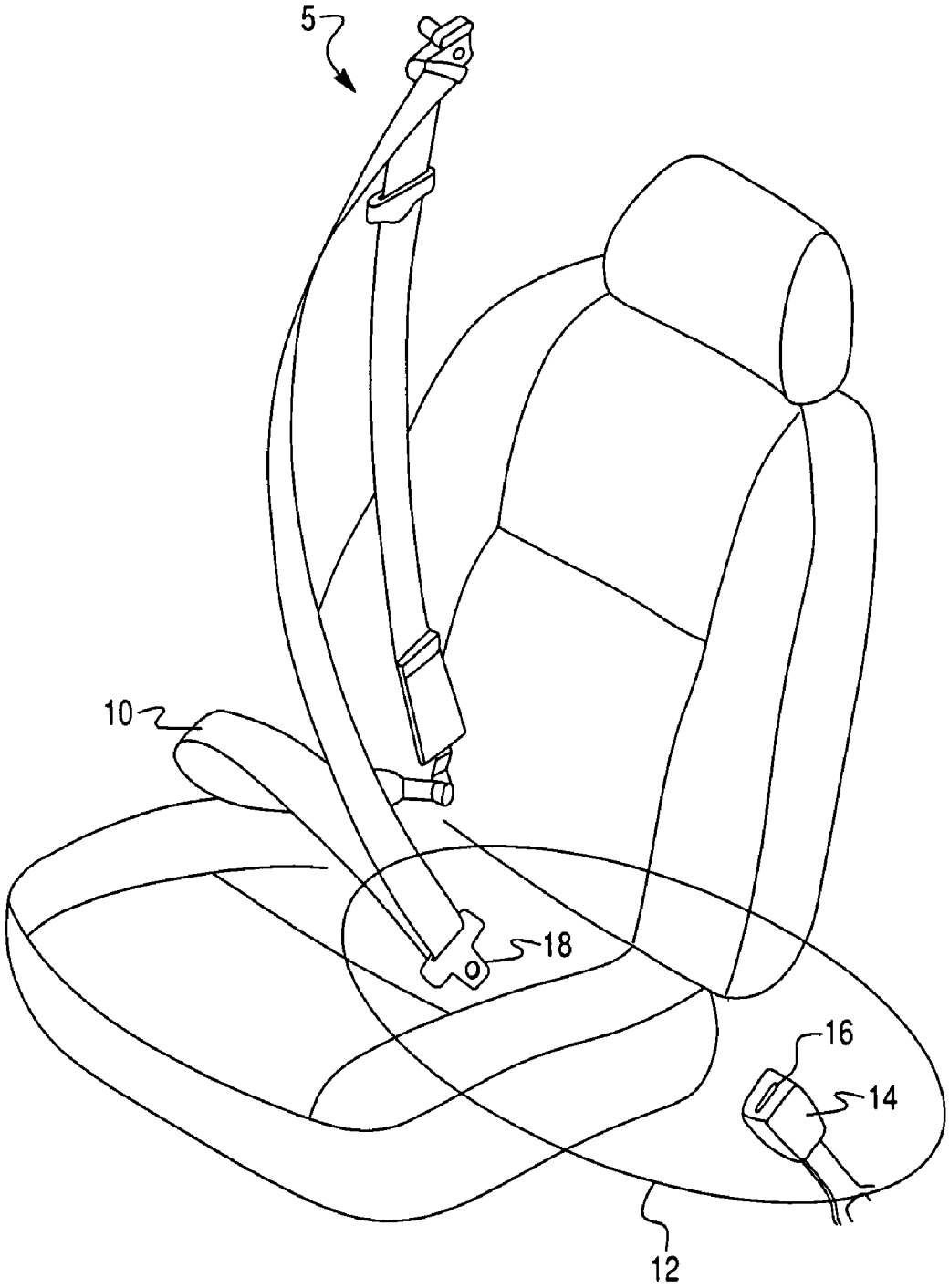
FIG. 1 is perspective view of an vehicle seat containing a seat belt according to an exemplary embodiment.
Figure 2:
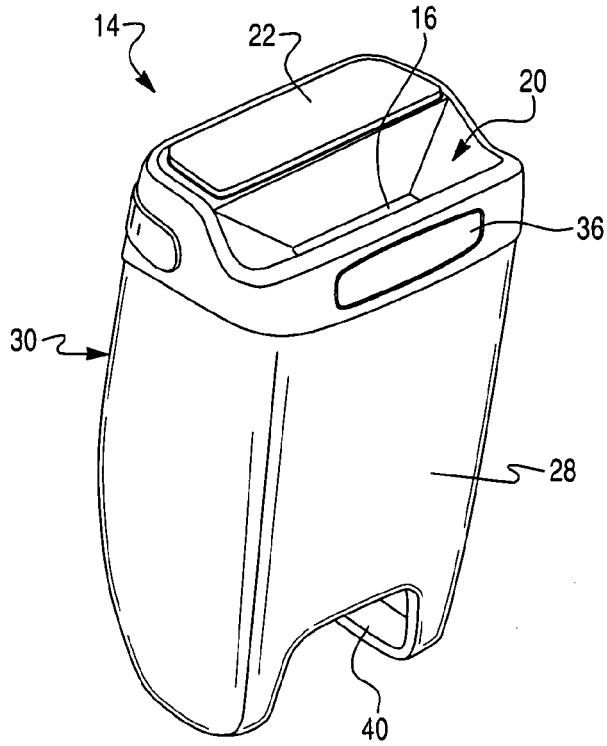
FIG. 2 is a rear perspective view of a seat belt buckle facing upright according to an exemplary embodiment.
Figure 3:
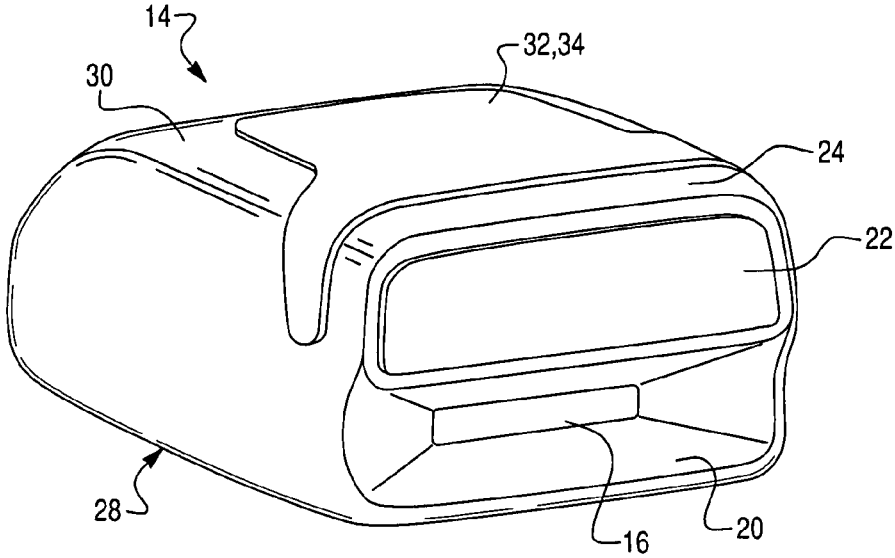
FIG. 3 is a left side perspective view of a seat belt buckle facing forward according to an exemplary embodiment.
Figure 4:
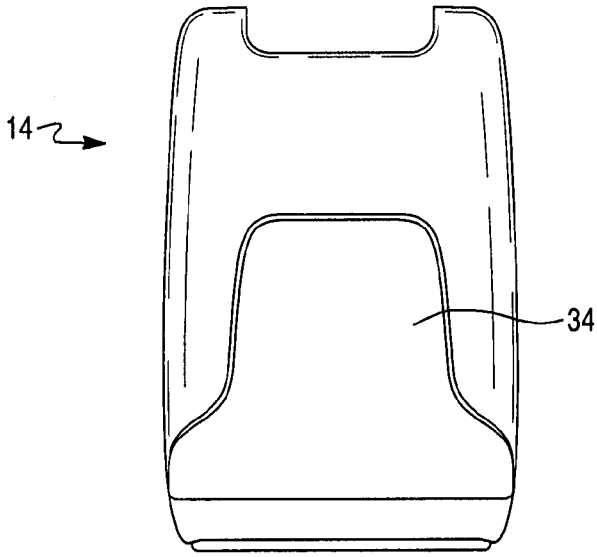
FIG. 4 is a front view of a seat belt buckle according to an exemplary embodiment.

Referring to FIG. 1, a vehicle seat 5 is shown with a seat belt 10 and seat belt buckle system 12, according to an exemplary embodiment. The seat belt buckle system 12 includes a seat belt buckle 14 with an opening 16 configured to receive a locking mechanism, i.e., tongue 18. The buckle 14 is positioned in a generally upright position. The locking mechanism or tongue 18 is connected to the webbing 10 of the seat belt.

Referring to FIGS. 2-6, an exemplary embodiment of the buckle 14 is illustrated. The opening 16 is located on the face 20 of the buckle 14. Also located on the buckle face 20 is a release button 22. When a vehicle occupant presses the release button 20, the tongue 18 may be detached from the buckle 14, and may slide out of the opening 16. The button 22 may operate in conjunction with a conventional ejector system (not shown).

In an exemplary embodiment, the buckle 14 includes a housing or cover including a bottom surface 40, a rear side surface 28 and a front side surface 30. The front side surface 30 includes a molded plastic portion 32. The molded plastic portion 32 may be made of a flexible material, such as santoprene or silicone, or any other suitable material. The molded plastic portion 32 may be used to form a seal 24 positioned on the buckle face 20 and around the button 22 to advantageously prevent contaminants, e.g., liquids, debris, etc., from penetrating the opening 16 and entering an interior cavity 26 of buckle 14.

Figure 9:
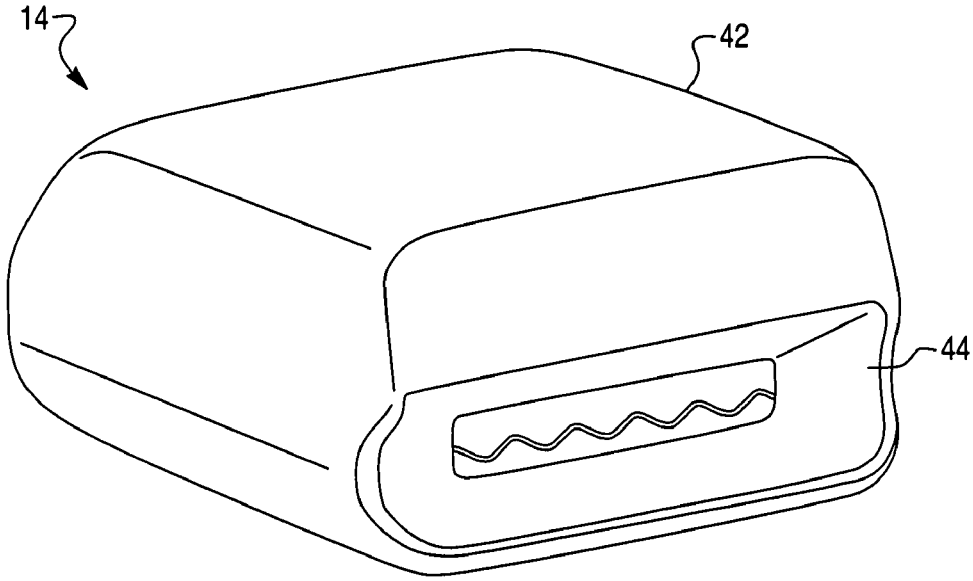
FIG. 9 is a left side perspective view of a seat belt buckle with a transparent sheathing applied according to an exemplary embodiment.

The seal 24 may be formed of a flexible material such as rubber or plastic and may form a curtain type barrier that is configured to block contaminants from entering the interior cavity 26 of buckle 14 through the opening 16. Also, the seal 24 may include top and bottom wall sections 23, 25 that meet by mating to form a complete barrier to contaminants. The top and bottom wall sections may be hinged so that the seal may retract when the tongue 18 is inserted into the opening 16. As shown in FIG. 9, the top and bottom wall sections of the seal 24 may meet along a curved boundary including peaks and valleys. Alternatively, the boundary could be straight or zigzagged. Alternatively, the seal may include a single wall or door that rotates out of position when the tongue 18 is inserted into the buckle. The flexible material of the seal 24 also would continue to serve the sealing function when the tongue 18 is inserted into the opening 16, because the flexible material of the seal 24 would maintain close contact with the tongue 18 to minimize or eliminate gaps between the tongue 18 and the buckle 14. The reduction of gaps between the tongue 18 and the buckle eliminates space for contaminants to potentially pass through into the interior 26 of the buckle housing.

Figure 6:
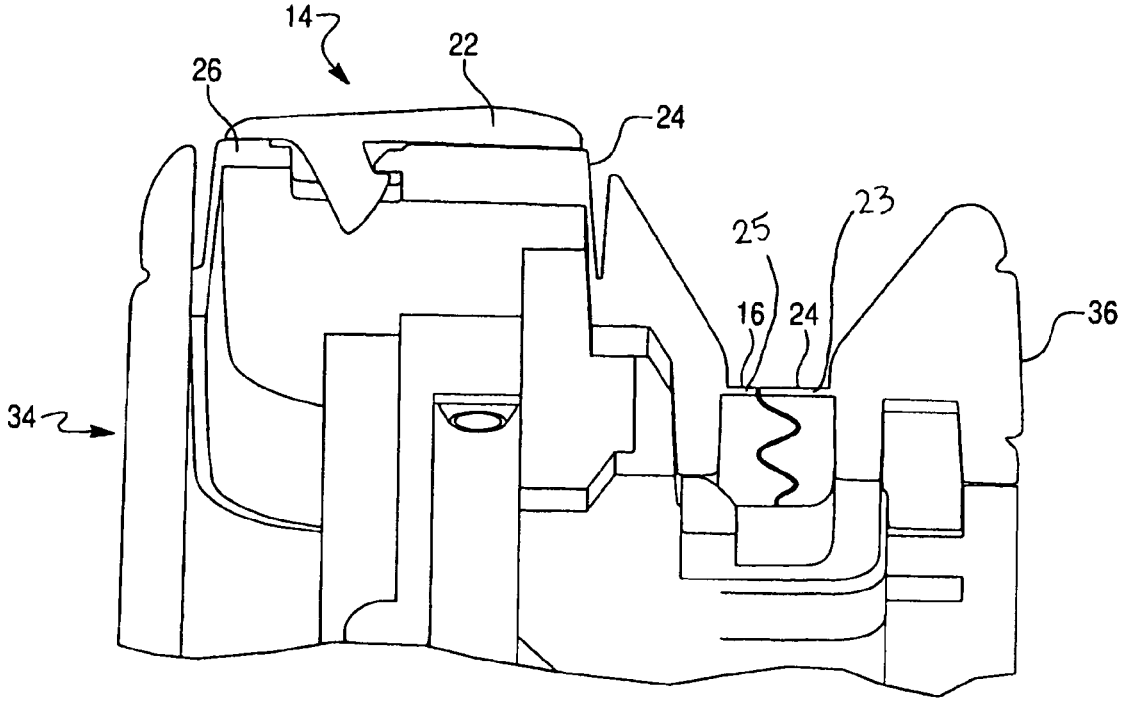
FIG. 6 is a cross section of a seat belt buckle according to an exemplary embodiment.
Figure 7:
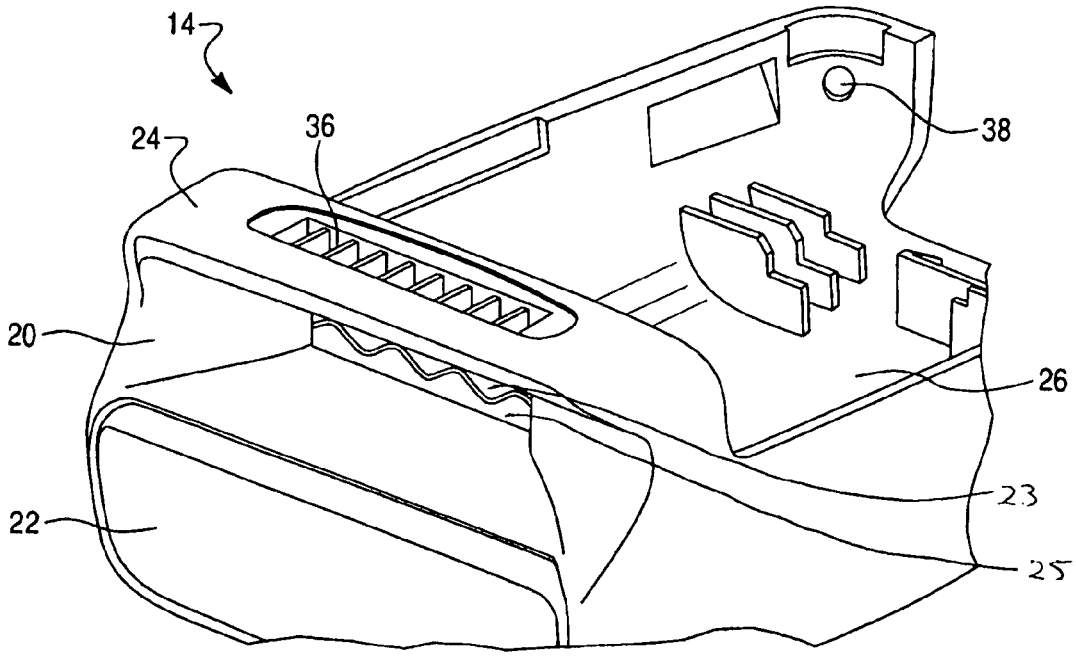
FIG. 7 is a right side perspective view of a seat belt buckle according to an exemplary embodiment.

Also, as shown in FIGS. 6 and 7, the seal 24 extends over the opening 16 and the seal 24 also seals the area around the button 22 to prevent contamination of the buckle mechanism. The location of the seal 24 under and around the buckle, provides a soft touch feel to the occupant and helps to reduce buzz, squeaks and rattles. Also, the seal 24 conceals the internal buckle operating mechanisms such as, for example, the button tongue ejector mechanism from the vehicle occupant.

The molded plastic portion 32 may be used by an occupant as a first grip surface 34 in conjunction with a second grip surface 36, located on the rear side surface 28, to assist the user when connecting the seat belt tongue 18 to the buckle 14. The first grip surface 34 and the second grip surface 36 may be made of the same flexible material as molded plastic portion 32, i.e., seal 24. The first and second grip surfaces 34, 36 may, alternatively, be made of a different suitable material. The first grip surface 34 and second grip surface 36 may aid in the reduction of squeaks, rattles, and other noises that occur as buckle 14 interacts with other components in the vehicle, e.g., consoles and other items. The first and second grip surfaces 34, 36 are shown having a generally rectangular shape. However, the first and second grip surfaces 34, 36 may be of any suitable shape or size.

Figure 5:
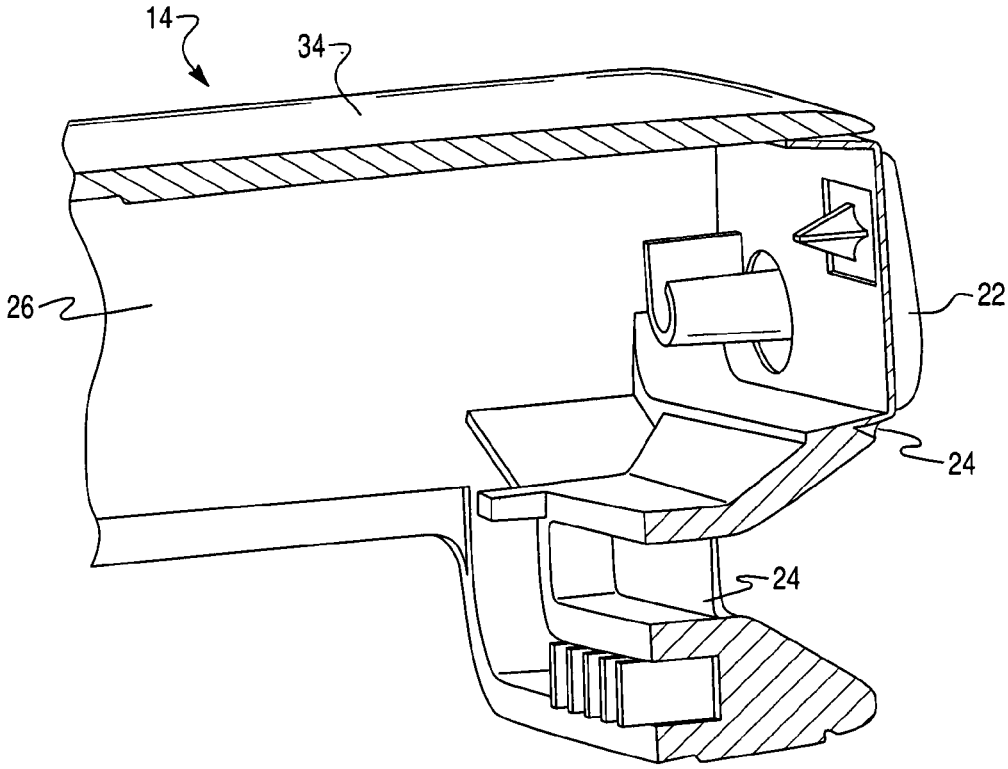
FIG. 5 is a cross section of a seat belt buckle according to an exemplary embodiment.

FIGS. 5-6 illustrate an interior cavity 26 of the buckle 14. In an exemplary embodiment, illustrated in FIG. 7, buckle 14 contains one or more drain hole(s) 38 which may be located on the bottom surface 40 of buckle 14. Drain hole 38 allows fluids to pass through the seat belt buckle system 12 should the fluids penetrate seal 24, effectively preventing the fluids from staying in the interior cavity 26 of buckle 14 and damaging the buckle 14 and related components.

Figure 8:
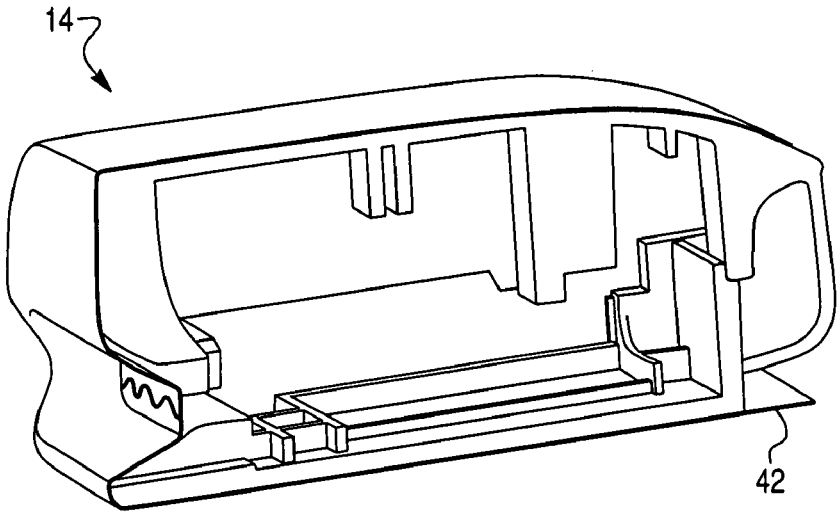
FIG. 8 is a cross section of a seat belt buckle with a transparent sheathing applied according to an exemplary embodiment.

In an exemplary embodiment, buckle 14 may be protected from contamination by a sheathing 42, as shown in FIGS. 8-9. Sheathing 42 may be placed over buckle 14 in the manner of a boot or a film. The sheathing 42 includes an opening 44 for receiving the seat belt tongue 18. Contaminants, such as liquid and debris, may then be prevented from entering the interior cavity 26 of buckle 14. Should liquid or debris pass through the sheathing 42, drain hole 38 (shown in FIG. 7) located on the bottom surface 40 of buckle 14 would provide a mechanism for removing the liquid or debris from the interior cavity 26 of buckle 14. Sheathing 42 may be made of a flexible material such as santoprene or silicone, or any other suitable material, and may be arranged to cover all the openings (except for an opening for the tongue) between the parts of the buckle cover or housing to reduce the possibility of debris entering the buckle. The sheathing 42 also would help to reduce buzz, squeaks and rattles by sealing and dampening movement and noise associated with the various buckle parts. The sheathing 42 may be transparent or opaque.

It is important to note that the construction and arrangement of the seat belt buckle system as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the description. For example, elements shown as integrally formed may be constructed of multiple parts or elements, the position of the elements may be reversed or otherwise varied, and the nature or number of discrete elements or positions may be altered or varied. Other substitutions, modifications, changes and omissions may be made in the design, operating conditions and arrangement of the exemplary embodiments.

What is claimed is:

1. A seat belt buckle system, comprising:

a seat belt buckle including a cover with a buckle face, a release button, and an opening for receiving a seat belt tongue, wherein the buckle includes a seal positioned on the buckle face to extend over the opening and to extend around the release button to seal the opening for the tongue to thereby provide a barrier to prevent contaminants from entering an interior cavity of the buckle, the seal including top and bottom wall sections positioned on an exterior of the buckle and configured to mate together to form a barrier.

2. The seat belt buckle of claim 1, wherein the buckle includes at least one drain hole on a bottom surface of the buckle cover.

3. The seat belt buckle of claim 1, wherein the seal comprises molded plastic.

4. The seat belt buckle of claim 3, wherein the buckle further includes front and rear side surfaces, the front side surface including a molded plastic portion to form a first grip surface for an occupant.

5. The seat belt buckle of claim 4, wherein the first grip surface is formed of the same material as the seal.

6. The seat belt buckle of claim 4, wherein the buckle further includes a second grip surface on the rear side surface.

7. The seat belt buckle of claim 6, wherein the second grip surface is formed of the same material as the seal.

8. The seat belt buckle of claim 6, wherein the first grip surface and the second grip surface are located on the exterior of the cover and form a relatively flexible surface that is configured to reduce or absorb noise resulting from contact between the buckle cover and other vehicle components.

9. The seat belt buckle of claim 1, wherein the seal comprises a flexible material.

* * * * *